US008942389B2

(12) United States Patent
Sridharan et al.

(10) Patent No.: US 8,942,389 B2
(45) Date of Patent: Jan. 27, 2015

(54) TRIM METHOD FOR CMOS-MEMS MICROPHONES

(75) Inventors: Sucheendran Sridharan, McMurray, PA (US); John Matthew Muza, Venetia, PA (US); Philip Sean Stetson, Wexford, PA (US)

(73) Assignee: Robert Bosch GmbH, Stuttgart (DE)

( * ) Notice: Subject to any disclaimer, the term of this patent is extended or adjusted under 35 U.S.C. 154(b) by 427 days.

(21) Appl. No.: 13/207,130

(22) Filed: Aug. 10, 2011

(65) Prior Publication Data

US 2013/0039500 A1 Feb. 14, 2013

(51) Int. Cl.

| | |
|---|---|
| ***H04R 3/00*** | (2006.01) |
| ***H04R 19/04*** | (2006.01) |
| ***H04R 9/08*** | (2006.01) |
| ***H04R 19/00*** | (2006.01) |
| ***H04R 31/00*** | (2006.01) |

(52) U.S. Cl.

CPC ..... *H04R 19/005* (2013.01); *H04R 19/04* (2013.01); *H04R 31/00* (2013.01)

USPC ..... 381/111; 381/113; 381/114; 381/115

(58) Field of Classification Search

USPC ..... 381/58, 111–115

See application file for complete search history.

(56) References Cited

U.S. PATENT DOCUMENTS

| | | | | |
|---|---|---|---|---|
| 8,094,839 | B2 | 1/2012 | Lee et al. | |
| 2006/0062406 | A1 | 3/2006 | Kinoshita | |
| 2006/0147061 | A1 | 7/2006 | Niwa et al. | |
| 2008/0075306 | A1 | 3/2008 | Poulsen et al. | |
| 2008/0118077 | A1* | 5/2008 | Rasmussen | 381/71.3 |
| 2010/0066390 | A1 | 3/2010 | Suzuki et al. | |
| 2010/0158274 | A1 | 6/2010 | Suvanto et al. | |
| 2010/0166228 | A1 | 7/2010 | Steele et al. | |

FOREIGN PATENT DOCUMENTS

| | | |
|---|---|---|
| WO | WO2009130626 | 10/2009 |

* cited by examiner

*Primary Examiner* — Duc Nguyen
*Assistant Examiner* — George Monikang
(74) *Attorney, Agent, or Firm* — Michael Best & Friedrich LLP

(57) ABSTRACT

Systems and methods for adjusting a bias voltage and gain of the microphone to account for variations in a thickness of a gap between a movable membrane and a stationary backplate in a MEMS microphone due to the manufacturing process. The microphone is exposed to acoustic pressures of a first magnitude and a sensitivity of the microphone is evaluated according to a predetermined sensitivity protocol. The bias voltage of the microphone is adjusted when the microphone does not meet the sensitivity protocol. The microphone is then exposed to acoustic waves of a second magnitude that is greater than the first magnitude and a stability of the microphone is evaluated according to a predetermined stability protocol. The bias voltage and the gain of the microphone are adjusted when the microphone does not meet the stability protocol.

23 Claims, 2 Drawing Sheets

TRIM METHOD FOR CMOS-MEMS MICROPHONES

BACKGROUND

The present invention relates to microphones, in particular MEMS microphones, with a moving membrane and a stationary backplate.

SUMMARY

MEMS (micro-electromechanical systems) microphones are constructed using CMOS processes. However, when using such processes to create a mechanical moving membrane for the microphone, there are variables that are not controlled during the fabrication and assembly process. As such, the thickness of the gap between the movable microphone membrane and the stationary backplate varies between microphones made according to the same processes. This variation affects the performance and sensitivity of the microphones as well as the stability of the microphone.

In one embodiment, the invention provides a method for adjusting a bias voltage and gain of the microphone to account for variations in a thickness of a gap between a movable membrane and a stationary backplate in a MEMS microphone. The microphone is exposed to a first sound level and a sensitivity of the microphone is evaluated according to a predetermined sensitivity protocol. The bias voltage of the microphone is adjusted when the microphone does not meet the sensitivity protocol. The microphone is then exposed to a second sound level and a stability of the microphone is evaluated according to a predetermined stability protocol. The amplitude of the second sound level is greater than the amplitude of the first sound level. The channel gain of the microphone is adjusted when the microphone does not meet the stability protocol. In some embodiments, the bias voltage is also adjusted when the microphone does not meet the stability protocol and the microphone is again evaluated according to the predetermined sensitivity protocol and the stability protocol.

In some embodiments, the sensitivity of the microphone is evaluated by comparing the output signal of the microphone to a threshold. The threshold is a percentage (or a value indicative of a percentage) of the possible full scale output signal. In some embodiments, the stability of the microphone is evaluated by determining if the sensitivity of the microphone changes when the second sound level—a sound level with greater amplitude—is applied to the microphone.

In some embodiments, the bias voltage and the channel gain are adjusted using existing pads on the MEMS microphone. A power supply voltage to the MEMS microphone is increased and, in response, the MEMS microphone logic enters a trim mode. A serial binary signal is then provided to the MEMS microphone logic using a first pad. The MEMS microphone logic adjusts the bias voltage and the channel gain based on the serial binary signal. When the power supply voltage to the MEMS microphone is lowered to a normal operating level, the MEMS microphone logic exits the trim mode. When not operating in the trim mode, the MEMS microphone logic receives a second serial binary signal on the first pad and controls a second operation of the MEMS microphone based on the second serial binary signal. The second operation of the MEMS microphone is unrelated to adjusting the bias voltage or the channel gain of the MEMS microphone.

The invention also provides a MEMS microphone including a membrane that moves relative to the MEMS microphone in response to acoustic pressures applied to the microphone, a stationary backplate positioned a distance from the membrane, a bias voltage module applying a bias voltage on the membrane and the stationary backplate, and a trim module. The trim module is configured to evaluate a sensitivity of the MEMS microphone based on a digital output of the MEMS microphone when a first sound level is applied. The bias voltage of the MEMS microphone is adjusted when the sensitivity does not meet a defined sensitivity protocol. The trim module also evaluates a stability of the microphone based on a digital output of the MEMS microphone when a second sound level is applied. The second sound level has greater amplitude than the first sound level. The channel gain and the bias voltage applied to the movable membrane and the stationary backplate are adjusted when the stability does not meet a defined stability protocol.

Other aspects of the invention will become apparent by consideration of the detailed description and accompanying drawings.

DETAILED DESCRIPTION

Before any embodiments of the invention are explained in detail, it is to be understood that the invention is not limited in its application to the details of construction and the arrangement of components set forth in the following description or illustrated in the following drawings. The invention is capable of other embodiments and of being practiced or of being carried out in various ways.

Figure 1A:
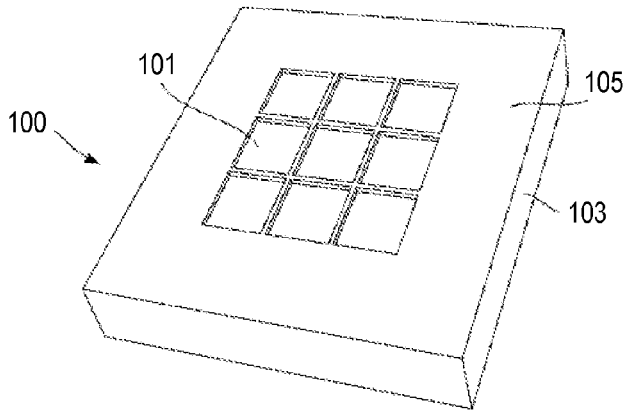
FIG. 1A is a perspective view of the top side of a CMOS-MEMS microphone according to one embodiment of the invention.
Figure 1B:
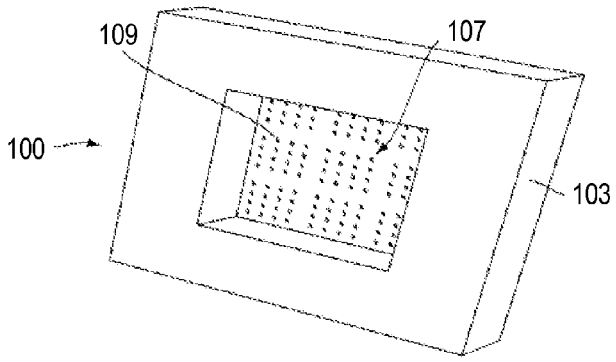
FIG. 1B is a perspective view of the bottom side of the CMOS-MEMS microphone of FIG. 1A.
Figure 1C:
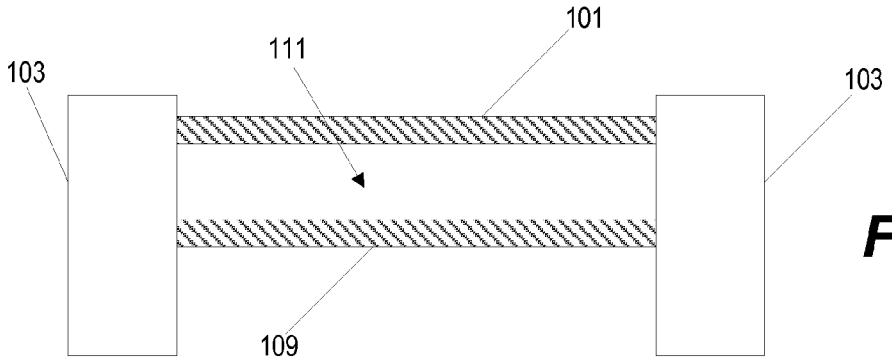
FIG. 1C is a cross-sectional view of the microphone of FIG. 1A.

FIG. 1A shows a CMOS-MEMS microphone 100. The microphone 100 includes a membrane or an array of membranes 101 supported by a silicon support structure 103. A logic layer 105 is located on top of the support structure 103 around the area of the membrane 101. The logic layer 105 includes logic components for controlling the operation of the microphone 100, processing the digital signal generated by the microphone 100, and communicating the digital signal to external devices such as a speaker or other sound processing equipment. The logic layer 105 also includes a plurality of contact pads (not pictured) for providing power and electronic communication between the MEMS microphone and external devices. As illustrated in FIG. 1B, the support structure 103 forms a square around the area of the membrane 101 leaving a back cavity 107. At the top of the back cavity 107 is a backplate 109. As illustrated in FIG. 1C, the structures are positioned to form a gap 111 between the membrane 101 and the backplate 109.

During operation, acoustic waves cause the membrane 101 to move relative to the stationary backplate 109. As the membrane 101 moves, the thickness of the gap 111 changes. A bias voltage is applied to the membrane 101 and the backplate 109 so that changes in the thickness of the air gap 111 and, therefore, the distances between the membrane 101 and the backplate 109, cause a change in a capacitance measured between the membrane 101 and the backplate 109. This change in capacitance is monitored and used to generate a digital signal representing the sound wave.

Due in part to the small scale of a MEMS microphone system and the CMOS processes used to manufacture the MEMS microphone, there are physical variations between microphones manufactured by the same process. These variations include, for example, the thickness of the CMOS layers 105, the interface between various layers, and time-dependent etchings and release etchings in the various silicon layers. As a result, the air gap 111 often has a varying thickness even between microphones manufactured by the same process.

Because the digital signal representing the sound wave is directly related to the thickness of the air gap 111, process variations result in performance variations. A smaller distance between the membrane 101 and the backplate 109 results in a higher sensitivity. However, the smaller distance also makes a "snap in" effect more likely. The "snap in" effect is when an electrical force or acoustic pressure between the membrane 101 and the backplate 109 causes the membrane 101 to physically touch the backplate 109 and not return to its original position. With high sound pressure events (loud noise), the acoustic pressure applied to the membrane 101 is great enough to cause the membrane 101 to come too close to the backplate 109. Conversely, when the air gap 111 is too thick, the microphone is less susceptible to the "snap in" effect, but will also exhibit a lower sensitivity.

Figure 2:
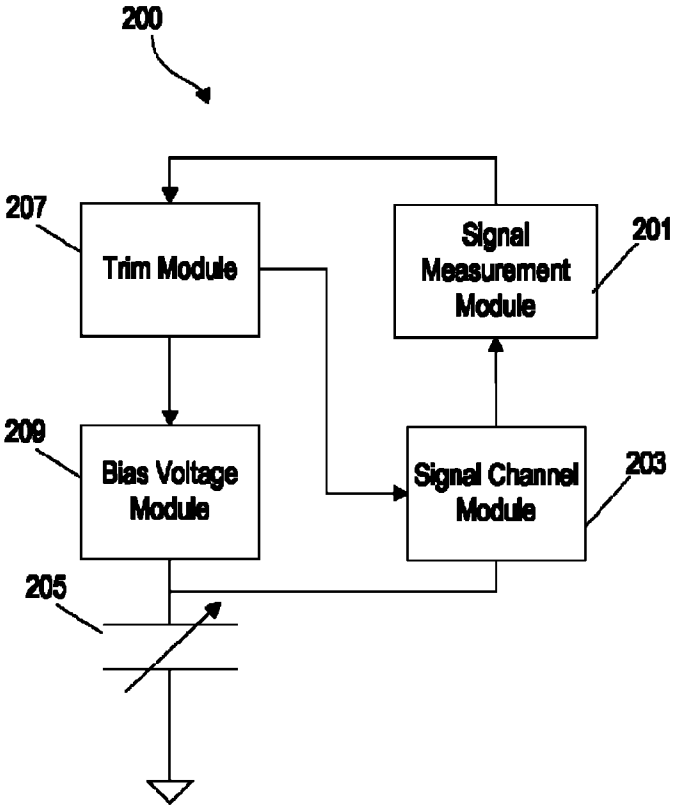
FIG. 2 is a block diagram of a circuit for adjusting the gain and bias voltage of the microphone of FIG. 1A.

FIG. 2 illustrates a microphone trim system 200 for evaluating and trimming the microphone 100 to account for manufacturing variations. The system includes a signal measurement module 201 that receives a digital signal from the signal channel module 203 based on changes in capacitance of the microphone 205. Microphone 205, as illustrated in FIG. 2 includes a membrane and backplate arrangement as described above in reference to FIGS. 1A, 1B, and 1C.

The signal measurement module 201 evaluates the digital signal and performs various tests to ensure that the performance of the microphone meets certain predefined requirements or protocols. The signal measurement module 201 communicates a signal to the trim module 207 indicating whether the microphone 205 meets the requirements. In response, the trim modules 207 adjusts the bias voltage provided by the bias voltage module 209 and the gain of the signal channel module 203 accordingly.

In some embodiments, as described in detail below, the time module 207, the bias voltage module 209, and the signal channel module 203 are implemented in the logic layer 105 of the MEMS microphone. The signal measurement module 201 is an external device that is connected to the output of the MEMS microphone and returns a trim code to the trim module after evaluating the signal. In other embodiments, the signal measurement module 201 is also implemented in the logic layer 105 so that the MEMS microphone does not need to be connected to other external equipment when the trim process is being performed.

Figure 3:
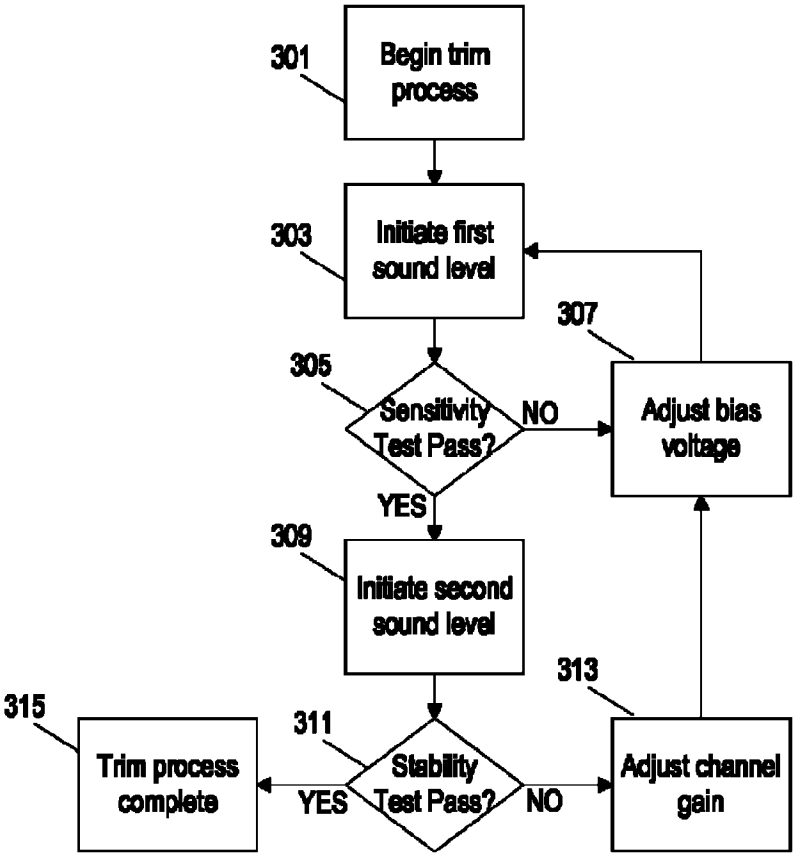
FIG. 3 is a flow chart of a method for adjusting the gain and bias voltage of the microphone of FIG. 1A.

FIG. 3 illustrates one method of trimming the microphone 205 using the system 200. In this method, the system 200 tests the microphone 205 for both sensitivity—the ability to respond to small variations in acoustic waves—and stability—the ability to avoid a snap-in effect caused by the electronic attraction between the membrane and the backplate due to the bias voltage.

The trim process is initiated (step 301) and a first sound level is applied to the microphone 205 by an external speaker (step 303). The first sound level is selected to test the sensitivity of the microphone 205. In some embodiments, the first sound level is from 94-104 dB and 1 KHz. The signal measurement module 201 evaluates the digital signal received from the microphone 205 and determines whether the microphone 205 meets a predefined sensitivity protocol (step 305).

The sensitivity of the microphone 205 is evaluated by comparing the output signal of the microphone to a threshold. The threshold is selected based on a percentage of a full, saturated signal. A signal is saturated when the magnitude of the signal is higher than the maximum signal amplitude that can be output by the system. For example, if the maximum output signal is 100 db, the system will output 100 db even if the signal should be 104 db or 110 db. In some embodiments, the threshold for evaluating the sensitivity of the microphone is set at 75% of the maximum output signal (also referred to as −25 db full-scale when the maximum output signal is 100 db).

If the output signal when the microphone 205 is exposed to the first sound level is less than the threshold, the microphone does not pass the sensitivity test. The signal measurement module 201 sends a trim code to the trim module 207, which then adjusts the bias voltage of the bias voltage module 209 accordingly (step 307). The microphone 205 is again exposed to the first sound (step 303) and the bias voltage is again adjusted (step 307) until the microphone 205 successfully passes the sensitivity test.

When the microphone 205 passes the sensitivity test, a second sound level is applied to the microphone 205 (step 309). The second sound level is selected to test the stability of the microphone 205 and has a greater amplitude than the first sound level. In some embodiments, the second sound level is 130-135 dB and 1 KHz. The signal measurement module 201 evaluates the digital signal received from the microphone 205 and determines whether the microphone 205 meets a predefined stability protocol (step 311). In some embodiments, the stability test evaluates the signal to determine if the sensitivity of the microphone changes in response to the higher amplitude sound. If the sensitivity has changed, the microphone does not pass the stability test.

If the microphone 205 does not pass the stability test, the trim module 207 adjusts the channel gain of the signal channel module 203 (step 313) and the bias voltage of the bias voltage module 209 (step 307). The microphone 205 must then again be exposed to the first sound level (step 303) to repeat the sensitivity test (step 305).

The sensitivity test (step 305) and the stability test (step 311) are repeated until the gain and the bias voltage are adjusted to levels where the microphone 205 successfully passes both the sensitivity test and the stability test. When the microphone 205 passes both tests, the trim process is complete (step 315). The microphone can then be packaged and shipped to consumers or installed in an end product.

If the membrane and the backplate are too close together, the microphone 205 will likely exceed the sensitivity threshold and pass the sensitivity test. However, the microphone 205 would then fail the stability test. The system 200 would decrease the bias voltage to reduce the likelihood of the "snap in" effect and increase the channel gain to account for losses in sensitivity caused by the lower bias voltage.

If the membrane and the backplate are too far apart, the microphone 205 will initially fail the sensitivity test. However, the bias voltage and, possibly the channel gain, will be increased to bring it within the acceptable range of both the sensitivity protocol and the stability protocol.

As described above, in some embodiments, the signal measurement module 201 is an external component temporarily connected to the microphone during the trim process. The signal measurement module evaluates the output signal from the microphone and sends a trim code to the trim module, which is implemented in the logic layer of the MEMS microphone. The trim module then adjusts the bias voltage or the channel gain based on the trim code, communication can be implemented through existing pads on the microphone system that serve other functions during normal operation of the microphone system.

To avoid the need for additional pads on the logic layer to communicate with the microphone logic, the signal measurement module transmits the trim code to the trim module through a pad that serves a different function during normal operation of microphone system. The power supply voltage provided to the microphone system is usually between 1 V and 3V. To enter the trim mode, this voltage is raised to a value above 3.5 V. When the power supply voltage has been raised, a serial binary trim code through a specific pad that usually serves another purpose unrelated to the trim method. The binary trim code is sent by toggling the input to the pad between two voltage levels. In other embodiments, the trim mode can be entered by mechanisms other than raising the power supply voltage.

In some embodiments, the trim code is three-digit binary number signaling new bias voltage and channel gain settings to be applied to the microphone based on the evaluation of the output signal performed by the signal measurement module. In other embodiments, the signal measurement module sends two separate trim codes to the trim module through the trim pad—the first indicating a new bias voltage setting and the second indicating a new channel gain setting. In still other embodiments, the trim code simply indicates whether the bias voltage or the channel gain should be increased, decreased, or left the same.

Thus, the invention provides, among other things, a system for adjusting a MEMS microphone to account for manufacturing variations. Various features and advantages of the invention are set forth in the following claims.

What is claimed is:

1. A method of adjusting a MEMS microphone to account for variations in manufacturing processes, the MEMS microphone including a gap of an undetermined thickness between a movable membrane and a stationary backplate, the method comprising:

applying a first voltage to a power supply voltage pad to enter a normal operation mode;

applying a first serial binary input to a second pad while in the normal operation mode, wherein a logic layer of the MEMS microphone performs a first operation unrelated to adjusting the bias voltage and the gain based on the first serial binary input while operating in the normal operation mode;

applying a second voltage, the second voltage higher than the first voltage, to the power supply voltage pad to enter a trim mode, applying a first sound level to the MEMS microphone;

evaluating a sensitivity of the MEMS microphone based on a digital output of the MEMS microphone when the first sound level is applied;

adjusting a bias voltage of the MEMS microphone by applying a binary trim code to the second pad as a second serial binary input when operating in the trim mode when the sensitivity does not meet a defined sensitivity protocol, wherein the binary trim code indicates an adjustment to the bias voltage of the MEMS microphone and wherein the trim module adjusts the bias voltage of the MEMS microphone according to the binary trim code;

applying a second sound level to the MEMS microphone, the second sound level having a greater amplitude than the first sound level;

evaluating a stability of the MEMS microphone based on a digital output of the MEMS microphone when the second sound level is applied; and when the stability does not meet a defined stability protocol, lowering the bias voltage and making a corresponding increase in a gain applied to the movable membrane and the stationary backplate by applying a second binary trim code as a third serial binary input to the second pad when operating in the trim mode, wherein the trim module adjusts the gain and the bias voltage of the MEMS microphone according to the second binary trim code.

2. The method of claim 1, further comprising repeatedly adjusting the bias voltage until the sensitivity of the MEMS microphone meets the defined sensitivity protocol.

3. The method of claim 1, wherein the defined sensitivity protocol includes a range of acceptable signal levels of the digital output of the MEMS microphone when the first sound level is applied.

4. The method of claim 1, further comprising repeatedly adjusting the gain and the bias voltage until the stability of the MEMS microphone meets the defined stability protocol.

5. The method of claim 1, wherein the defined stability protocol includes a range of acceptable changes in the sensitivity of the MEMS microphone when the first sound level is increased to the second sound level.

6. The method of claim 1, further comprising, after adjusting the stability of the MEMS microphone, repeating the acts of applying the first sound level, evaluating the sensitivity of the MEMS microphone, and adjusting the sensitivity of the MEMS microphone.

7. The method of claim 6, further comprising, after repeating the act of adjusting the sensitivity of the MEMS microphone, repeating the acts of applying the second sound level, evaluating the stability of the MEMS microphone, and adjusting the stability of the MEMS microphone.

8. The method of claim 1, wherein evaluating the stability of the MEMS microphone includes determining whether the sensitivity of the microphone changes in response to applying the second sound level.

9. The method of claim 1, wherein evaluating the sensitivity of the MEMS microphone includes determining whether the digital output of the MEMS microphone surpasses a threshold in response to applying the first sound level.

10. The method of claim 1, wherein the defined sensitivity protocol and the defined protocol constitute at least part of a defined uniform performance criteria to be achieved by a plurality of microphones.

11. A MEMS microphone system comprising:

a membrane that moves relative to a MEMS microphone in response to acoustic pressures applied to the MEMS microphone;

a stationary backplate positioned a distance from the membrane;

a bias voltage module applying a bias voltage on the membrane and the stationary backplate;

a trim adjustment system including a trim module integrated into a logic layer of the MEMS microphone and a signal measurement module that is selectively connectable to the MEMS microphone configured to evaluate a sensitivity of the MEMS microphone based on a digital output of the MEMS microphone when a first sound level is applied, adjust the bias voltage applied to the membrane and the stationary backplate when the sensitivity does not meet a defined sensitivity protocol, evaluate a stability of the MEMS microphone based on a digital output of the MEMS microphone when a second sound level is applied, the second sound level having a greater amplitude than the first sound level, and when the stability does not meet a defined stability protocol, lower the bias voltage and make a corresponding increase in a gain applied to the movable membrane and the stationary backplate;

a power supply voltage pad, the power supply voltage pad receiving a first voltage during a normal operation mode; and a second pad, the second pad receiving a first serial binary input during normal operation of the MEMS microphone, wherein the logic layer of the MEMS microphone performs a first operation unrelated to adjusting the bias voltage and the gain based on the first serial binary input, wherein the MEMS microphone operates in a trim mode when a second voltage is applied to the power supply voltage pad, the second voltage being greater than the first voltage, wherein, when operating in the trim mode, the signal measurement module evaluates the sensitivity of the MEMS microphone and evaluates the stability of the MEMS microphone and further generates a binary trim code indicating an adjustment to at least one of the bias voltage and the gain of the MEMS microphone, and transmits the binary trim code as a second serial binary input to the trim module through the second pad, and wherein, when operating in the trim mode, the trim module adjusts the bias voltage and the gain of the MEMS microphone according to the binary trim code.

12. The MEMS microphone system of claim 11, wherein the trim adjustment system is further configured to repeatedly adjust the bias voltage until the sensitivity of the MEMS microphone meets the defined sensitivity protocol.

13. The MEMS microphone system of claim 11, wherein the defined sensitivity protocol includes a range of acceptable signal levels of the digital output of the MEMS microphone when the first sound level is applied.

14. The MEMS microphone system of claim 11, wherein the trim adjustment system is further configured to repeatedly adjust the gain and the bias voltage until the stability of the MEMS microphone meets the defined stability protocol.

15. The MEMS microphone system of claim 11, wherein the defined stability protocol includes a range of acceptable changes in the sensitivity of the MEMS microphone when the first sound level is increased to the second sound level.

16. The MEMS microphone system of claim 11, wherein the binary trim code indicates an adjustment to both the bias voltage and the gain of the MEMS microphone.

17. The MEMS microphone system of claim 11, wherein the signal measurement module is not physically integrated into the MEMS microphone system and is selectively connectable to the second pad of the MEMS microphone system.

18. The MEMS microphone system of claim 11, wherein the trim adjustment system is further configured to repeat the evaluation of the sensitivity and the adjustment of the sensitivity of the MEMS microphone after adjusting the stability of the MEMS microphone.

19. The MEMS microphone system of claim 18, wherein the trim adjustment system is further configured to repeat the evaluation of the stability and the adjustment of the stability of the MEMS microphone after repeating the adjustment of the sensitivity of the MEMS microphone.

20. The system of claim 11, wherein the stability of the MEMS microphone is evaluated based on whether the sensitivity of the microphone changes when the second sound level is applied.

21. The system of claim 11, wherein the sensitivity of the MEMS microphone is evaluated based on whether the digital output of the microphone surpasses a threshold when the first sound level is applied.

22. The system of claim 11 wherein the defined sensitivity protocol and the defined stability protocol constitute at least part of a defined uniform performance criteria to be achieved by a plurality of microphones.

23. A MEMS microphone system comprising:

a membrane that moves relative to a MEMS microphone in response to acoustic pressures applied to the MEMS microphone;

a stationary backplate positioned a distance from the membrane;

a bias voltage module applying a bias voltage on the membrane and the stationary backplate;

a trim adjustment system including a trim module integrated into a logic layer of the MEMS microphone and a signal measurement module that is selectively connectable to the MEMS microphone;

a power supply voltage pad, the power supply voltage pad receiving a first voltage during a normal operation mode; and a second pad, the second pad receiving a first serial binary input during normal operation of the MEMS microphone, wherein the logic layer of the MEMS microphone performs a first operation unrelated to adjusting the bias voltage and the gain based on the first serial binary input, wherein, the MEMS microphone operates in a trim mode when a second voltage is applied to the power supply voltage pad, the second voltage being greater than the first voltage, wherein, when operating in the trim mode, the signal measurement module evaluates the sensitivity of the MEMS microphone and evaluates the stability of the MEMS microphone and further generates a binary trim code indicating an adjustment to at least one of the bias voltage and the gain of the MEMS microphone, and transmits the binary trim code as a second serial binary input to the trim module through the second pad, and wherein, when operating in the trim mode, the trim module adjusts the bias voltage and the gain of the MEMS microphone according to the binary trim code.

* * * * *